United States Patent [19]

Korytkowski et al.

[11] 4,338,671

[45] Jul. 6, 1982

[54] METHOD AND APPARATUS FOR MONITORING THE PASSAGE OF ARTICLES THROUGH A MODULAR PROCESSING SYSTEM

[75] Inventors: Henry M. Korytkowski; Frederick H. Dear, both of Rochester, N.Y.

[73] Assignee: Burroughs Corporation, Detroit, Mich.

[21] Appl. No.: 99,961

[22] Filed: Dec. 3, 1979

Related U.S. Application Data

[63] Continuation of Ser. No. 844,475, Oct. 21, 1977.

[51] Int. Cl.[3] ..... G08B 21/00; B65H 7/02

[52] U.S. Cl. ..... 364/478; 271/259; 340/675; 364/550

[58] Field of Search ..... 364/478, 550; 271/258, 271/259, 265; 101/232; 340/675; 355/14 R

[56] References Cited

U.S. PATENT DOCUMENTS

| | | | |
|---|---|---|---|
| 3,204,950 | 9/1965 | Hanchett, Jr. | 271/259 |
| 3,626,956 | 12/1971 | Sauder | 271/259 X |
| 3,815,102 | 6/1974 | Plunkett | 364/900 |
| 3,878,540 | 4/1975 | Kawai | 271/259 |
| 3,944,933 | 3/1976 | Gallet | 340/675 X |
| 3,987,429 | 10/1976 | Manduley et al. | 364/478 X |
| 3,995,953 | 12/1976 | Kawai | 340/675 X |
| 3,999,851 | 12/1976 | Sakamaki et al. | 271/259 X |
| 4,022,460 | 5/1977 | Pritchett | 271/258 |
| 4,026,543 | 5/1977 | Leclere | 271/259 |
| 4,084,900 | 4/1978 | Yamaoka et al. | 271/258 X |

*Primary Examiner*—Felix D. Gruber

*Attorney, Agent, or Firm*—James E. Ledbetter; David G. Rasmussen; Kevin R. Peterson

[57] ABSTRACT

Article tracking logic apparatus for monitoring plural articles passing through a modular article processing system. An article path actuator activates discrete logical paths for tracking each article within the processing modules. Each logical path includes an article position memory which updatably stores the position of an associated article within an activated path. An article tracking update means is provided within each logical path to cooperate with article position transducers and error detection logic to determine abnormal article transport conditions within an active path. Decode logic is provided within each logical path to provide the control unit for the processing system with the precise path and position therein where an error has occurred.

8 Claims, 5 Drawing Figures

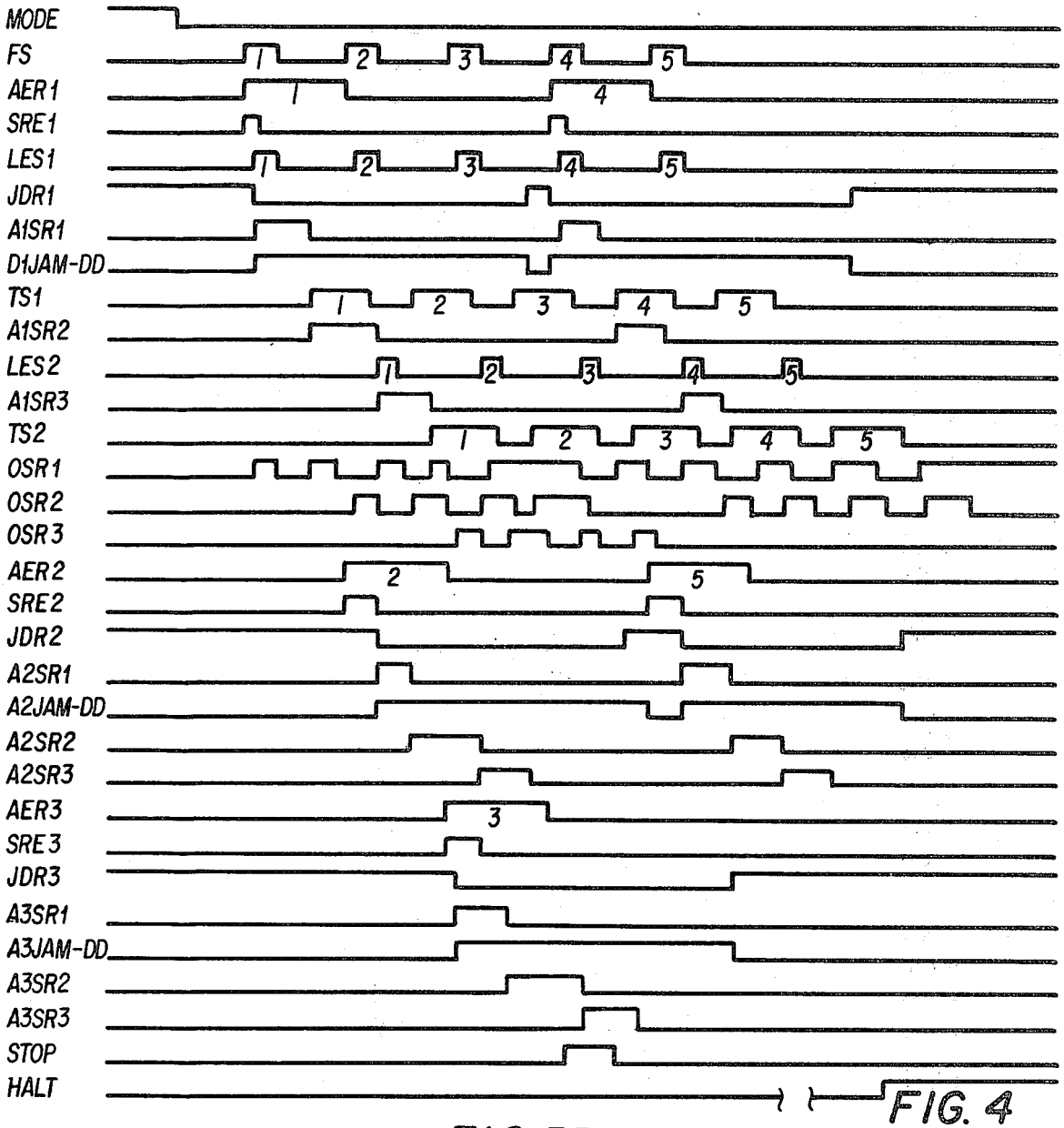
FIG. 4
FIG. 5A
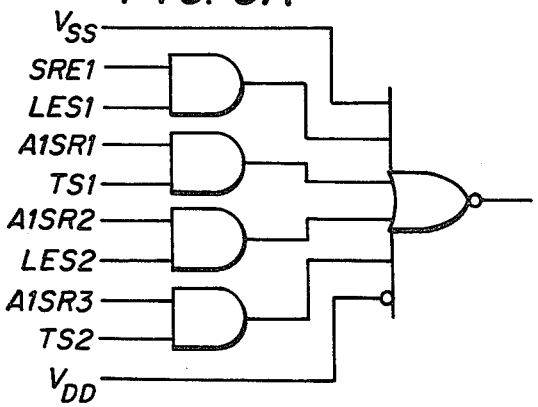
FIG. 5B
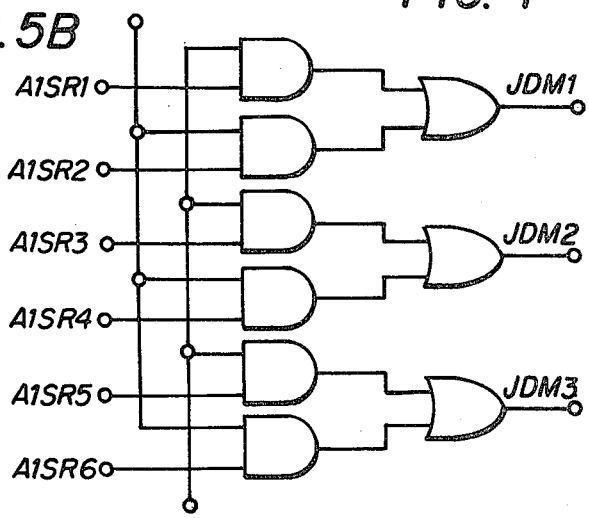

METHOD AND APPARATUS FOR MONITORING THE PASSAGE OF ARTICLES THROUGH A MODULAR PROCESSING SYSTEM

This is a continuation of application Ser. No. 844,475, filed Oct. 21, 1977.

FIELD OF THE INVENTION

The invention relates to an apparatus and method for monitoring the passage of plural articles through a modular article processing system.

BACKGROUND OF THE INVENTION

The disclosed apparatus and method relate with particularity to Ser. No. 844,520 filed on even date herewith, now U.S. Pat. No. 4,197,797 entitled "Modular High Speed Printing System" and assigned to the common assignee. The instant modular article tracking logic system exhibits utility in any modular article processing system wherein it is necessary to monitor the passage of individual articles through a plurality of processing modules. Since the processing system is modular it is highly advantageous that the article tracking logic system be expandable to accommodate the additional processing capability of the processing system as additional processing modules are employed. Similarly, the logic system should have the functional flexibility to accommodate the assembly of processing modules in any order. Also, the logic system should be capable of indentifying both the occurrence and location of processing failures and bring the processing system to a logically consistent halt such that all articles will be accounted for and any article which may be processed will be processed.

SUMMARY OF THE INVENTION

An object of this invention is to provide a logic system for monitoring the processing of articles within a modular processing system.

It is also an object of this invention to provide a logic system which is expandable to accommodate a variable number of processing modules.

It is a further object of this invention to provide a logic system which activates a discrete logical path for each article within the processing system.

A related object of this invention is to provide a logic system capable of detecting the occurrence and position of errors within the processing modules to insure that all articles within the apparatus are either processed or accounted for.

It is another object of this invention to provide an inexpensive and reliable logic system for monitoring the passage of articles through a modular article processing system.

These and other objects are accomplished by a modular logic system which establishes a discrete logical path for each article which is being processed by the modular processing system. Each of the discrete logical path corresponds to a logical monitoring system for tracking an article through the processing modules. Each article which is being processed in the system will have associated with it one logical article path which was activated to monitor the article when it entered the system. Each of the discrete logical paths includes an article tracking memory which receives inputs from article sensing transducers within the processing modules to determine whether processing is proceeding normally. Processing failures are determined by the article tracking memories when an article has not entered and exited a processing module within a certain time period. The article tracking update means supplies the position of the error to decode circuitry which cooperates with the control system of the article processing system to discontinue processing in a logically consistent manner.

BRIEF DESCRIPTION OF THE DRAWINGS

The novel features of this invention which are believed to be characteristic thereof are set forth with particularity in the appended claims. The invention, however, both as to its organization and method of operation together with further objects and advantages thereof, may best be understood with reference to the following description taken in connection with the accompanying drawings.

FIG. 4 is a timing diagram to be read in conjunction with FIGS. 3*a* and 3*b*.

FIG. 5A exhibits an embodiment of the internal circuitry of logic gate $\mathbf{137}_1$ and $\mathbf{137}_2$ and FIG. 5B exhibits an embodiment of the decode circuitry $\mathbf{81}_1$.

FIG. 1 shows an embodiment of a modular article processing system which could be employed in conjunction with the logic system of the instant invention. The article processing system processes articles in a serial manner by feeding the articles in series from a feeder module through a succession of processing modules to a receiver module. In FIG. 1, feeder 11 is shown as the starting point for the article processing path 12 shown by the dashed line which continues from the feeder 11 through the processing modules 13, 15 and 17 to the article receiver 19. System control 21 for the article processing apparatus resides within feeder 11. Feed sensor 23 provides a signal to the system control for each item which is fed by feeder 11. The feed sensor could, for example, be a solid state detector which includes in a single housing a phototransistor and a light emitting diode. The diode and phototransistor are angularly related such that light from the diode would be reflected to the phototransistor when an article in the path 12 passes the sensor 23. The reflection of light back to the phototransistor by the surface of the article results in a feed sensor pulse FS passing from the feed sensor 23 to the system control 21. The feed sensor 23 could, however, be any type of sensor including magnetic or thermal depending on the type of article which is being processed by the apparatus.

An article passing from feeder module 11 to the first processing module 13 encounters a lead edge sensor 25 which could be the same type of sensor as feed sensor 23. Lead edge sensor 25 supplies a pulse LES1 which indicates that an article has entered the first processing module within the article path 12. The LES1 signal is supplied to the system control 21 and to the module control 33. An article work area 27 is shown within the article path 12 followed by trip sensor 29 which also could be a sensor similar to feed sensor 23 and lead edge sensor 25. Trip sensor 29 supplies a pulse TS1 which indicates that an article has reached the trip sensor and could, for example, be employed by a module control unit 33 to actuate article stop 31 such that preselected portions of the article will be stopped in a selected position over work area 27. In the referenced copending application the work area 27 is a vertically reciprocatable printing platen which functions in conjunction with a print head to print on documents which are positioned on the platen by the article stop 31. It should, however, be understood that the presently disclosed apparatus and method are usable in other processing functions. As will be explained later, the timing between a LES1 pulse and a TS1 pulse is critical in determining whether there has been a jam of the article within a processing module. After the processing has been completed in the first module 13 the article will pass into the second processing module 15. Again, a lead edge sensor 35 is provided to supply a LES2 pulse to the system control and module control 43. A second work area 37 is shown within article path 12. Trip sensor 39 supplies a trip sensor pulse TS2 to both the system control 21 and the module control 43. An appropriate stop mechanism 41 is shown in a position to stop an article in the path 12 over work area 37. Processing module 17 is shown as a third processing module serially interconnected within the processing apparatus. A lead edge sensor 45 provides a lead edge signal LES3 to system control 21 and module control 53. A third article work area 47 resides within the article path 12 as does trip sensor 49. The trip sensor supplies a trip sensor pulse TS3 to system control 21 and module control 53. Article stop 51 is shown as in the other processing modules. Article receiver 19 is coupled to the end of the serially interconnected processing modules to receive articles discharged from the article path 12. Although FIG. 1 shows three processing modules in conjunction with a feeder module and a receiver module, it should be understood that the logic control system of the instant invention can be employed with as few as a single processing module or with processing modules in excess of three.

FIG. 2 illustrates in block diagram form the logic system for monitoring the passage of articles through a plurality of processing modules. Referring back to FIG. 1 it can be readily appreciated that the processing of articles will be more efficient if multiple articles can be simultaneously processed by the modules. The instant logic system can simultaneously monitor a large number of articles within the processing modules. It has been found most advantageous to feed the articles to the processing modules such that when an article is over a work area 27, 37, 47, another article would be passing from feeder module 11 to processing module 13 or from one processing module to the next successive processing module. Thus, it will readily be understood that the logic system must have the capability to monitor a number of articles in excess of the number of processing modules.

In FIG. 2 the logical article paths are indicated by the dashed lines corresponding to $71_1$, $71_2$, $71_3$, and $71_n$. Each logical article path corresponds to a logic monitoring system for tracking an article through the processing modules; the path contains all the logical elements necessary to monitor the passage of an article from the feeder 11 through the processing modules 13, 15 and 17 to the receiver module 19. The logic system of each logical article path receives inputs from the feed sensor 23, the lead edge sensors 25,35 and 45 and the trip sensors 29,39 and 49 to update the position of the article within the logical path. The article path actuator 73 receives inputs from system control 21 and feed sensor 23 to activate a logical article path each time an article is fed by the feeder 11. Upon an article being sensed by feed sensor 23, a feed sensor pulse is fed into shift register 107 of article path actuator 73 and shift register 107 is stepped one position. This sends a signals along line AER1 through NAND gate 131 and inverter 131 into the load position of shift register 135 and the first position of gate $137_1$. The signals from the lead edge sensors and trip sensors of each processing module provide inputs into article tracking update means $77_1$. The signals from the lead edge sensors and the trip sensors are indicative of the article's position within the processing system and are employed to update the stored location of the article within the article position memory $75_1$. The article position signals are employed in conjunction with a jam detector circuit $79_1$ to determine whether an article has jammed within any processing module or between processing modules. If no jam occurs then jam detector circuit $79_1$ is reset by an incoming article position signal through article tracking update means $77_1$. If, however, a jam has occurred decode circuit $D_1$ is employed to indicate to system control 21 the position of the article jam.

If the article path actuator 73 receives a feed sensor signal indicating that another article has been fed into the article path 12 while a succeeding article is still being processed by the logical article path $71_1$ then article path actuator 73 will activate the logical article path $71_2$. This logical article path contains logical processing devices identical with those in logical article path $71_1$. These devices include the article position memory $75_2$, article tracking update means $77_2$, jam detector circuit $79_2$ and decode circuit $81_2$. The decode circuit also communicates with the system control 21.

If a third article is fed into the article path 12 while the succeeding two articles are being processed then the article path actuator will similarly activate logical article path $71_3$. The article path actuator 73 continues to activate logical article paths in response to feed sensor signals indicating that an additional article has been fed to the article processing modules. The logic system contemplates providing at least a sufficient number of logical article paths to accommodate the maximum number of articles which can be processed by the modules at one time. Thus, it is seen that each article, while it is being processed in the system, will have associated with it in a one-to-one manner each of the plurality of logical article paths which was activated to monitor the article when it entered the processing system.

Figure 1:
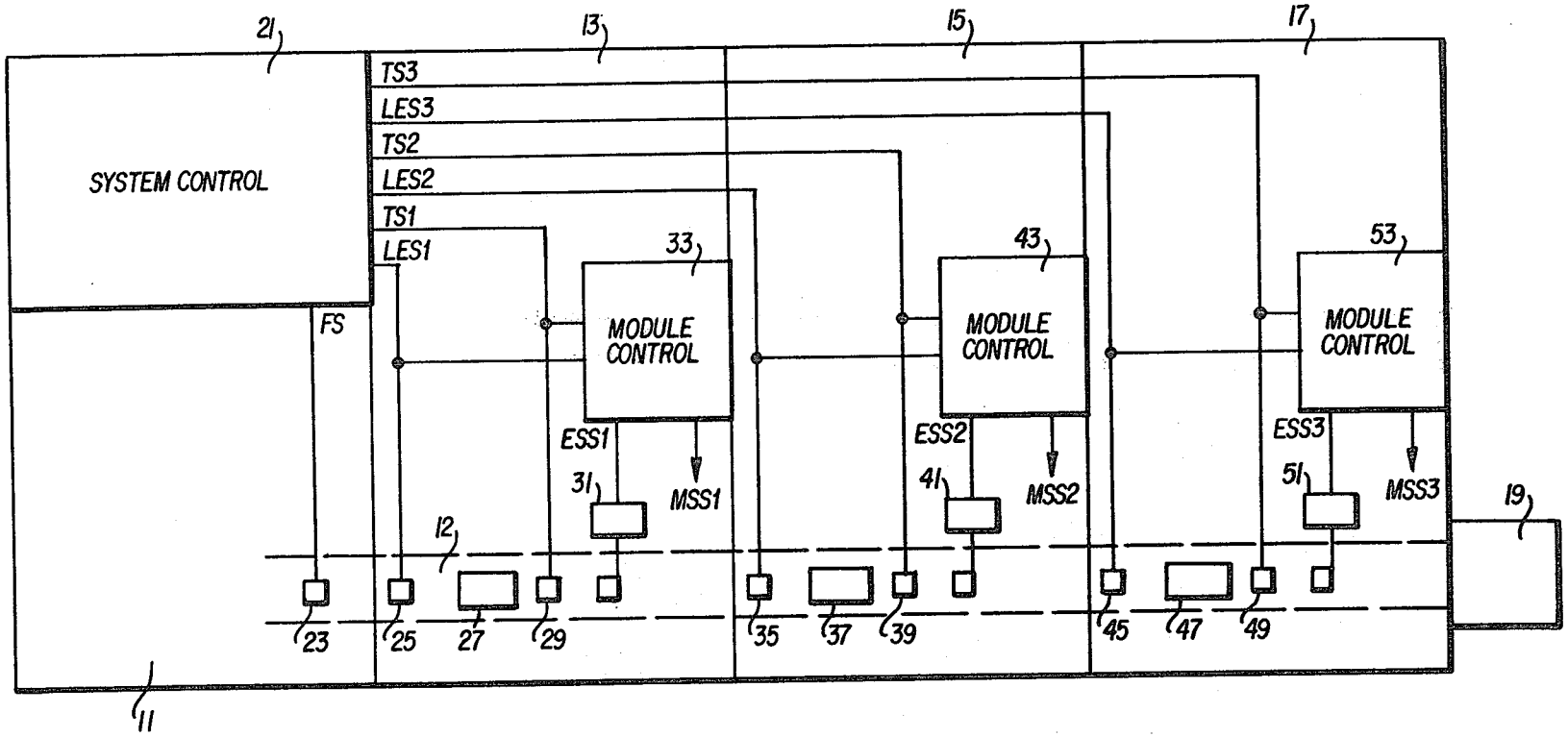
FIG. 1 shows a schematic embodiment of a modular processing system with which the instant logic system can be employed.
Figure 2:
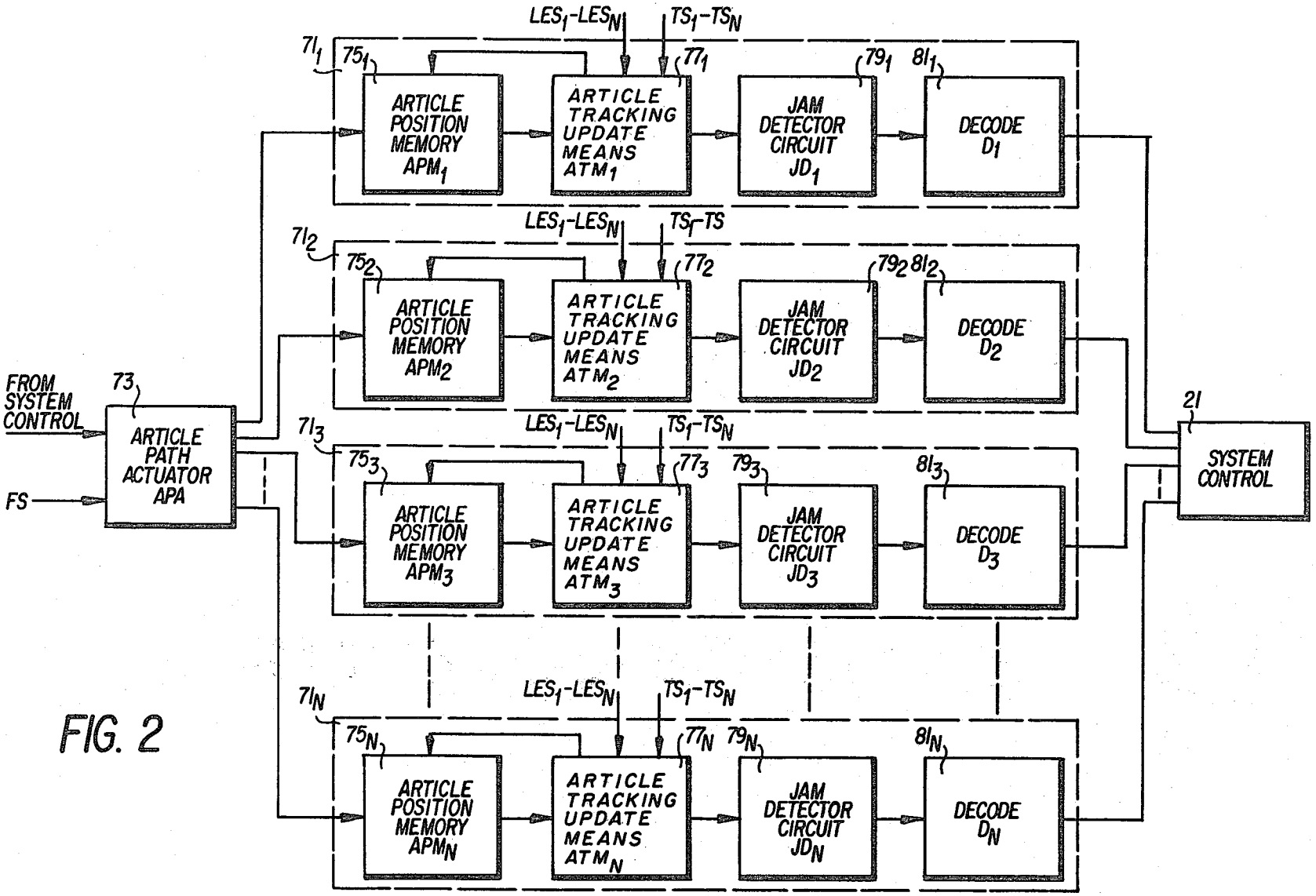
FIG. 2 shows the logic system in block diagram form.
Figure 3A:
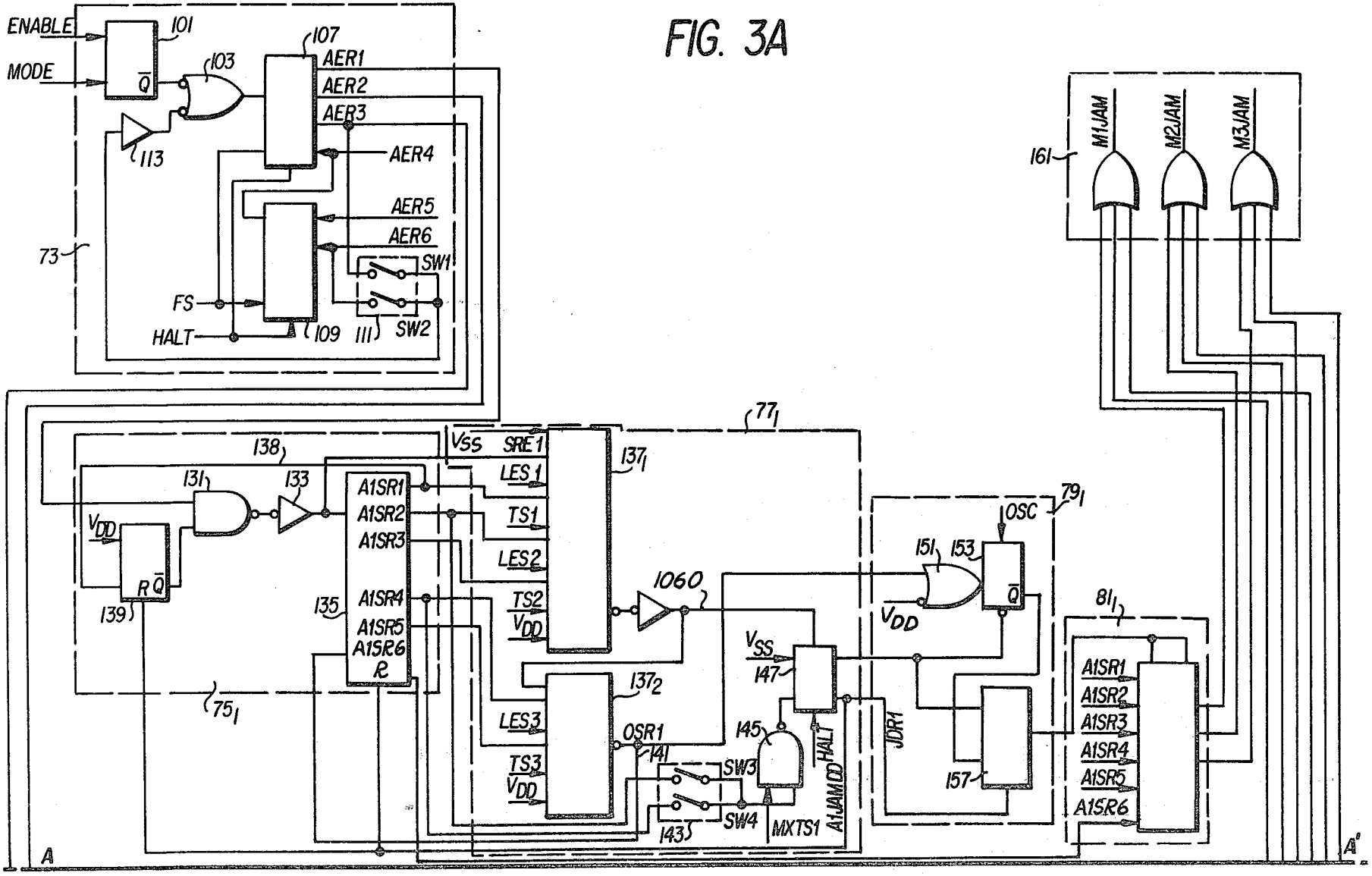
FIGS. 3*a* and 3*b* exhibit an organization of logical devices which comprise an embodiment of the instant invention.
Figure 3B:
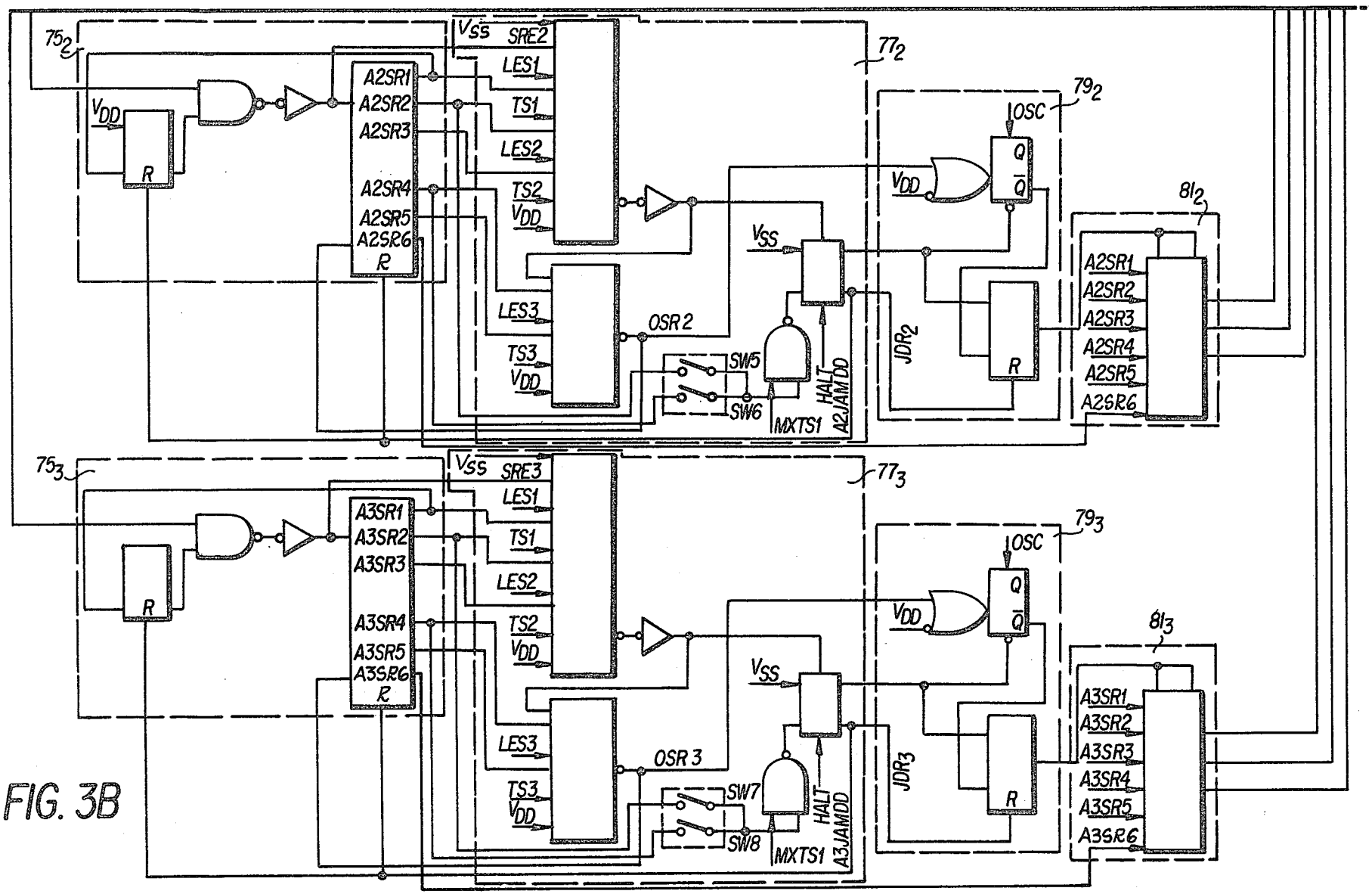

FIGS. 3A and 3B depict an embodiment showing article path actuator 73 and three logical article paths. The components in FIGS. 3A and 3B which comprise the article position memories of the logical paths are indicated by the dotted portion $75_1$, $75_2$ and $75_3$. The components comprising the article tracking update means are enclosed by dotted lines and correspond to $77_1$, $77_2$ and $77_3$. The jam detector circuits are shown in $79_1$, $79_2$ and $79_3$ and the decode circuits likewise are $81_1$, $81_2$ and $81_3$.

The article path actuator 73 includes a flip-flop 101 which supplies a pulse through the $\overline{Q}$ output when the modular processing system is placed into the ready mode. Before the system enters the ready mode, the Q output of flip-flop 101 is low and the $\overline{Q}$ output is high. When the modular processing system goes low. This causes the $\overline{Q}$ output to go low, the output of OR gate 103 to go high, and an entry to be made in the load position of shift register 107. Once the input is in shift register 107 the article path actuator is capable of activating a logical article path upon the occurrence of a feed sensor pulse. Assuming that an initial document is fed, a FS pulse is supplied to shift register 107 to shift its entry one position. This causes article path AER1 to become active and the one in the first position of shift register 107 reflects that the first logical article path has been activated. If another FS pulse occurs the shift register 107 is shifted one more position and article path AER2 is activated. Similarly, if a third FS pulse occurs shift register 107 is shifted to place an entry into its third position and logical article path AER3 is activated. The switch element 111 is provided to determine when a wrap-around is required on shift register 107. If the processing system comprises a single module then it is capable of holding only three articles at a time and, therefore, after the third logical article path has been activated the next path which will be available will be AER1. Thus, for a single module processing system a pulse is taken off AER3 and would pass through a closed SW1 in switch unit 111 to inverter 113 and OR gate 103. This places an entry in the load position of shift register 107 such that the next feed sensor pulse will again activate logical article path AER1. If the processing apparatus has two modules than SW2 will be closed and there will be wrap-around of shift register 107 after logical article path AER6 has been activated. Simultaneously with the activation of logical article path AER4 an entry will be placed into the load position of shift register 109 which stores entries for logical article paths AER5 through AER6.

The dashed portion $75_1$ in FIGS. 3A and 3B depicts the article position memory for the first logical article path. Shift register 135 stores data indicating the particular module within which an article resides. When the first logical article path is to be activated an AER1 signal supplied from the logical article path actuator 73 to NAND gate 131 and inverter 133 places an entry into the first position of shift register 135. The shift register 135 serves as a memory to updatably record the particular processing module within which the article associated with logical article path 1 is currently residing. An entry in the first position of shift register 135 indicates that the article will soon be or currently is residing in the first processing module. Lead 138 is fed back to shift register 135 through flip-flop 139 and NAND gate 131 and serves to inhibit any other inputs to the shift register 135 from article path actuator 73 while that path is still active.

The article tracking update means $77_1$ includes gates 137, and $137_2$. An embodiment of the internal circuitry of these gates is shown in FIG. 5A $137_1$ and $137_2$. An entry is made in the first position of gate $137_1$ by an SRE1 pulse supplied from INVERTER 133 simultaneously with the pulse supplied to shift register 135. This indicates that an article should be entering the first processing module and the signal from the first lead edge sensor is expected. The gates $137_1$ and $137_2$ accept inputs signals from the lead edge sensors and trip sensors of the processing modules and employ these signals to step the entry within gates $137_1$ and $137_2$ along in conjunction with the passage of articles through the processing modules. The gates $137_1$ and $137_2$ also receive module indicating signals from shift register 135 and these signals are labeled A1SR1, A1SR2, . . . A1SR5. Lead 141 from gate $137_2$ is fed back to shift register 135 to step the entry in shift register 135 along to coincide with the module within which the article associated with logical article path is currently residing. Switch unit 143 is provided as a means to effect the wrap-around for the article tracking update means gates $137_1$ and $137_2$ according to the number of processing modules within the system. The switch unit 143 functions similarly to the switch unit 111 in that if the system is formed from a single module then inputs will only be expected from lead edge sensor 1 and trip sensor 1 and switch SW3 will be closed to insure that the logical article path is reset after an indication has been received that the article has passed trip sensor 1 successfully. Similarly, switch SW4 is provided if two modules are in use within the system and it should be understood that switch unit 143 would contain additional switches to accommodate additional modules within the article processing system. NAND gate 145 cooperates with flip-flop 147 to reset flip-flop 139, shift register 135 and the flip-flop 157 after the final trip sensor in the processing apparatus has indicated that an article has passed it successfully.

The jam detector circuit is shown within dashed portion $79_1$. The jam detector circuit includes gate 151 employed to reset and retrigger one-shot 153. The one-shot 153 has connected at one input an oscillator which counts up to the point where the one-shot will time out if it has not been reset within a predetermined time period. If the one-shot 153 times out an input is supplied to flip-flop 157 which indicates that a jam has occurred within the processing apparatus and it must be decoded by decode circuit $81_1$. An input is supplied to gate 151 every time an article hits a lead edge sensor or trip sensor and this restarts the period of one-shot 153. As long as the article passes through the processing modules such that lead edge sensors and trip sensors are encountered within the prescribed time limit the one-shot 153 will be reset and retriggered and will not time out. After an article has passed the final trip sensor within the processing apparatus as indicated by the switch unit 143 a reset signal is supplied from flip-flop 147 to reinitialize the article path for subsequent activation by the article path actuator 73.

Decode circuit $81_1$ receives inputs from flip-flop 157 and shift register 135. The inputs from the shift register 135 indicate the module within which the article associated with logical article path 1 is currently residing. If a jam has occurred an output is supplied to module indicating circuit 161 with the signals M1JAM, M2JAM and M3JAM being supplied to system control as indications that a jam has occurred within particular modules. The system control uses the signals from the module indicating circuit 161 such that if a jam occurs in module 2 any articles in module 3 are permitted to process normally whereas article stops within modules 1 and 2 are positioned within the article paths to prevent any further passage of the articles through the modules. Also, of course, the feeder module is deactivated as soon as a jam has been detected. While no circuit is described for actuating the article stops and disabling the feeder it is felt that it is well within the ability of one skilled in the art to implement such actions and, therefore, they are not described in detail herein.

The elements which comprise logic article path 2 are set forth in FIG. 3*b*. Article position memory $75_2$ comprises elements similar to those within article position memory $75_1$. The same holds true for the article tracking update means $77_2$ jam detector circuit $79_2$ and the decode circuit $81_2$. FIG. 3*b* also exhibits the logical elements for implementing logical article path 3. It is felt that detailed description of these logical article paths is not required because they contain the same logical elements as logical article path 1 and function in an identical manner.

The cooperation of the circuit elements within a logical article path will best be understood when the elements depicted in FIGS. 3*a* and 3*b* considered in conjunction with the timing diagram of FIG. 4. The logical system is activated by the mode signal going low as an input to flip-flop 101 which, as heretofore explained, results in an entry being placed in the first position of the shift register 107. The timing diagram depicts the feeding of five documents in the feeder module and the FS pulses are numbered 1 through 5. The first feed FS pulse supplied to shift register 107 results in activation of article path 1 by an AER1 signal being provided to NAND gate 131 and inverter 133. In addition, an entry is placed in the first position of shift register 135 in the A1SR1 position and also the SRE1 signal being provided to gate $137_1$. At this point the system expects and the timing diagram shows the next input to be from lead edge sensor 1. An LES1 pulse for the first article is provided to gate $137_1$ and at the same time reset signal JDR1 goes low, thus enabling the jam detector circuit of logical article path 1. This begins the countdown of the one-shot 153. If one-shot 153 times out before the first article passes by the first trip sensor, a jam signal will go out from flip-flop 157 to decode circuit $81_1$. The LES1 pulse, coincident with the SRE1 pulse as shown in FIG. 5A and FIG. 4, results in a high output on line 1060 in FIG. 3A which is fed into gate $137_2$. This in turn results in a simultaneous output OSR1 from gate $137_2$. The OSR1 pulse resets the one-shot 153 through the OR gate 151 so that the system can determine whether the expected trip sensor pulse from the trip sensor of the first processing module will be arriving within a suitable time interval. The OSR1 pulse is fed back over line 141 to shift register 135 such that the shift register 135 reflects that the article is approaching trip sensor 1. This further results in signal A1SR2 being provided to gate $137_1$. Trip sensor 1 supplies the next pulse to the logical system over line TS1 to gate $137_1$. Again this results in an OSR1 being supplied to gate 151, to reset and retrigger one-shot 153, and to shift register 135, to step shift register 135 to the A1SRZ position. Since we are assuming no jam has occurred one-shot 153 has not timed out and the jam detector circuit $79_1$ will next be waiting for an indication that the article has reached the lead edge sensor from module 2.

The next input supplied to the system is from the feed sensor which results in article path actuator 73 having its entry in shift register 107 shifted one position to activate logical article path 2 by means of pulse AER2. The next pulse indicates that the article within article path 1 has passed the trip sensor in module 1 and the logical article path will expect a signal from the lead edge sensor of module 2. The pulse from lead edge sensor 2 is received by gate $137_1$ and output OSR1 is generated to reset and retrigger the jam detector circuit $79_1$ as well as shift the entry in shift register 135 one more position to A1SR3. This results in output A1SR3 being supplied to gate $137_1$ and the system next expects an input from the trip sensor in module 2. The timing diagram in FIG. 4 indicates that the trip sensor pulse from module 2 is generated as an input TS2 to gate $137_1$ which, as has been previously described, results in a regeneration of the OSR1 pulse to reset and retrigger the one-shot 153 and shift the entry in shift register 135 one more position to A1SR4. The output A1SR4 from shift register 135 is provided to gate $137_2$ but more importantly is also provided to the switch unit 143. In switch unit 143 switch SW4 will be closed because the processing system in this example includes two processing modules. Once the article associated with logical article path 1 passes trip sensor 2 then it will be received by the receiver module and logical article path 1 will again become available to the article path actuator 73. This is accomplished by NAND gate 145 suppling input to flip-flop 147 which supplies the reset pulse JDR1 to flip-flop 157, flip-flop 139 and shift register 135. Thus, logical article path 1 has been re-enabled to monitor another article fed from the feeder module. Referring back to the timing diagram of FIG. 4, the feed sensor pulse FS which corresponds to the feeding of the fourth article does indeed result in logical article path 1 being reactivated by the article path actuator 73. This can be seen as the signal AER1 going high simultaneously with indication of the fourth FS pulse.

The timing diagram of FIG. 4 exhibits the pulses generated for processing articles 2, 3, 4 and 5 but it is felt that the explanation of the processing of one article as been heretofore described is sufficient to render an understanding of how the logical circuit of FIG. 3 functions in conjunction with the article processing system.

FIG. 5A has been provided to exhibit an embodiment of shift register $137_1$ such that one skilled in the art will understand how the reception by shift register $137_1$ of the pulses from the feed sensors and the trip sensors of the modules results in the OSR1 reset pulses and the shifting of the entries in shift register 135. The circuit element shown in FIG. 5B exemplifies an embodiment of the decode circuits and show how by the inputs A1SR1 through A1SR5 it is possible to determine where within the processing modules a jam has occurred.

To summarize the manner in which the described apparatus functions the article path actuator 73 selects a logical article path for monitoring each article fed by the feeder module. Logical article path 1 comprises article position memory $75_1$, article tracking update means $77_1$, jam detector circuit $79_1$ and a decode circuit $81_1$. The method of operation comprises supplying an input to the article position memory at each instance that the article hits either a lead edge sensor or a trip sensor of the processing modules. The article position memory for logical article path 1 includes a shift register having positions labeled A1SR1 through A1SR4. These positions correspond to the physical positions of the articles in the processing system in the following manner: an entry in A1SR1 indicates that an artical has passed the first lead edge sensor. A1SR2 corresponds to an article passing the first trip sensor. Likewise, entries in A1SR3 and A1SR4 respectfully correspond to the article passing the lead edge sensor in the second module and the trip sensor in the second module. The article tracking update means embodied in elements $137_1$ and $137_2$ provide means for the logical article path to be updated by inputs from the article processing system. The lead edge sensors and trip sensors provide these updating inputs. The jam detector circuit $79_1$ provides a resettable and retriggerable timing mechanism which monitors the time interval required for the article to pass successive article sensors. If this time interval is longer than the period of the one-shot 153 the jam detector $79_1$ signals that a jam has occurred by supplying input to the flip-flop 157. If, however, the article processes normally through the modules the jam detector circuit $79_1$ is periodically reset by the lead edge sensors and trip sensors. The decode circuit $81_1$ accepts inputs from the article position memory 75, such that upon the occurrence of a jam it is possible to determine where within the processing modules the jam occurred.

The foregoing description is intended to be explanative of an article tracking system and method to be employed with a module article processing apparatus to monitor the processing of articles therein. It will be understood from the foregoing that various changes may be made in the preferred embodiment illustrated and it is intended that the foregoing description be taken as illustrative only and not in a limited sense. The scope of the invention is defined by the following claims.

What is claimed is:

1. An apparatus establishing logical article paths for monitoring the processing of articles within a modular article processing system, comprising:

a plurality of logical article paths for tracking the position of articles within said article processing system, each of said logical article paths comprising memory means for updatably storing data indicating the position of said associated article within said processing system, means coupled to said memory means for periodically updating the position of said associated article within said memory means responsive to a change in the position of said associated article within said article processing system, processing system failure detection means coupled to said updating means for detecting the failure of said article processing system upon the failure of an article to change position within a predetermined time period; and decode means coupled to said detection means for determining the malfunctioning module within a modular article processing system; and means for associatively activating article path in response to each article entered into the processing system, whereby each article will be associated with an individual logical article path while it is being processed in said processing system.

2. The apparatus of claim 1 wherein said means for associatively activating a logical article path comprises:

first shift register means having a storage location assigned to each logical path;

means for placing an entry in the first storage location of said first shaft register means; and means for shifting the entry one position in said first shift register means in response to each entry of an article into the processing system.

3. The apparatus of claim 1 wherein said means for updatably storing the position of an associated article comprises a second shift register means.

4. The apparatus of claim 3 wherein said means coupled to said memory means for periodically updating said memory means comprises:

position sensing means in each module of said modular article processing system for generating article position signals responsive to the presence of an article;

logic gate means receiving said position signals for storing an entry of the most recent location of said associated article within said processing system, said logic gate means for correlating said position signals and a said stored entry to update both the location stored in said second shift register means and the location in said logic gate means representing the most recent location of said associated article.

5. The apparatus of claim 4 wherein said processing system failure detection means comprises:

retriggerable timing means for generating an output signal if said retriggerable timing means is not retriggered within a selected time interval;

means for triggering said retriggerable means in response to said position signals; and means receiving the output signal from said retriggerable means for generating an error signal in response thereto.

6. The apparatus of claim 5 wherein said decode means coupled to said failure detection means comprises:

means for correlating said error signal and the location stored in said second shift register means for indicating the module within said modular processing system wherein said error has occurred.

7. Apparatus for detecting and locating article jams within a modular serial article processing system, said apparatus comprising:

a plurality of updatable memory means for storing data indicating the position of associated articles being processed serially along an article path within said modular article processing system;

means for associating one of said plural memory means with each article entered into said modular processing system, whereby each article will be associated with an individual updatable memory means while it is being processed in said processing system;

means for updating a said memory means responsive to a change in location within the modular processing system of an article associated with said memory means;

means for detecting an article jam if a said memory means is not updated within a predetermined time period; and, article jam locating means cooperating with said article jam detecting means for determining the position of the article causing the jam within said modular article processing system.

8. In a modular article processing system which includes a feeder module for feeding articles into said system, at least one processing module coupled to the feeder module for processing articles fed by said feeder module and a receiver module, coupled to said at least one processing module, a system for detecting article jams within said modular processing system, comprising:

feed sensor means for generating a feed sensor signal for every article fed by said feeder module;

first article sensor means within said at least one processing module for generating a signal upon an article entering said processing module;

a second article sensor within said at least one module for generating a signal upon an article entering said processing module;

a plurality of logical article paths for tracking the position of articles within said article processing system;

logical article path actuator means for activating a logical article path upon the occurrence of a said feed sensor signal;

updatable article position memory means for storing data indicating the position within the article processing system of the article associated with said activated logical article path;

article tracking update means receiving the signals from said first sensor means and said second sensor means within each of said processing modules for updating the article position memory means in said activated article path in response to a change in location of said associated article within said article processing system;

jam detector means for generating an error signal upon the failure of said article position memory means to be updated within a predetermined time period; and, decoder means receiving the jam detector signal for determining the position of said jam within said modular processing system.

* * * * *